US011526107B2

(12) United States Patent
Saito et al.

(10) Patent No.: US 11,526,107 B2
(45) Date of Patent: Dec. 13, 2022

(54) IMAGE FORMING APPARATUS

(71) Applicant: CANON KABUSHIKI KAISHA, Tokyo (JP)

(72) Inventors: Tomohiro Saito, Chiba (JP); Shozo Aiba, Ibaraki (JP); Kenta Matsuzaki, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/496,947

(22) Filed: Oct. 8, 2021

(65) Prior Publication Data

US 2022/0113664 A1 Apr. 14, 2022

(30) Foreign Application Priority Data

Oct. 13, 2020 (JP) ..... 2020-172575

(51) Int. Cl.
*G03G 15/00* (2006.01)
*G03G 15/08* (2006.01)

(52) U.S. Cl.
CPC ..... *G03G 15/5041* (2013.01); *G03G 15/0849* (2013.01); *G03G 15/5058* (2013.01)

(58) Field of Classification Search
CPC ..... G03G 15/5041; G03G 15/0849; G03G 15/5058
See application file for complete search history.

(56) References Cited

U.S. PATENT DOCUMENTS

| | | | | |
|---|---|---|---|---|
| 9,256,167 | B2 | 2/2016 | Nagata et al. | |
| 10,268,150 | B2 | 4/2019 | Aiba | |
| 2012/0189335 | A1* | 7/2012 | Miyamoto | G03G 15/5054 399/66 |
| 2017/0227889 | A1* | 8/2017 | Seku | G03G 15/0849 |
| 2019/0107797 | A1* | 4/2019 | Murayama | G03G 15/5062 |

FOREIGN PATENT DOCUMENTS

| | | | |
|---|---|---|---|
| JP | 2012-203097 | A | 10/2012 |
| JP | 2015-045835 | A | 3/2015 |
| JP | 2018-010143 | A | 1/2018 |
| JP | 2018-120104 | A | 8/2018 |

* cited by examiner

*Primary Examiner* — Sandra Brase
(74) *Attorney, Agent, or Firm* — Venable LLP

(57) ABSTRACT

The control unit executes a mode of detecting the image density of the toner image for control. The control unit sets the target toner density so that the target toner density becomes smaller than before execution of the mode and also set the target transfer current so that the target transfer current becomes smaller, in a case where the image density detected in the mode is higher by a predetermined threshold or more than a reference density.

11 Claims, 8 Drawing Sheets

FIG.4

| DETERMINATION RESULT Q/m OF TONER CHARGE QUANTITY | | Vlowlim =Vtrgt | Vlowlim <Vtrgt< Vuplim | Vtrgt =Vuplim |
|---|---|---|---|---|
| | | SECTION 1 | SECTION 2 | SECTION 3 |
| Qth1<PATCH IMAGE DENSITY | SECTION 1 | 4 | 4 | 5 |
| Qth2<PATCH IMAGE DENSITY≤Qth1 | SECTION 2 | 3 | 3 | 4 |
| Qth3<PATCH IMAGE DENSITY≤Qth2 | SECTION 3 | 3 | 3 | 3 |
| Qth4<PATCH IMAGE DENSITY≤Qth3 | SECTION 4 | 2 | 3 | 3 |
| PATCH IMAGE DENSITY≤Qth4 | SECTION 5 | 1 | 2 | 2 |

FIG.5

| RELATIVE HUMIDITY (%) | Qth1 (V) | Qth2 (V) | Qth3 (V) | Qth4 (V) |
|---|---|---|---|---|
| 5 | 110 | 60 | -60 | -110 |
| 30 | 100 | 55 | -55 | -100 |
| 50 | 90 | 50 | -50 | -90 |
| 70 | 77 | 43 | -43 | -77 |
| 90 | 70 | 40 | -40 | -70 |

FIG.6

| | PROCESSING SPEED (mm/s) | | |
|---|---|---|---|
| | 300 | 200 | 100 |
| m_YMC | 0.04 | 0.035 | 0.03 |
| n_YMC | 0.88 | 0.895 | 0.91 |
| m_K | 0.05 | 0.065 | 0.08 |
| n_K | 0.5 | 0.75 | 0.76 |

FIG.7

| ENVIRONMENT SECTION | 0 | 1 | 2 | 3 | 4 | 5 | 6 | 7 |
|---|---|---|---|---|---|---|---|---|
| ABSOLUTE MOISTURE CONTENT (g/m³) | 0.9 ~3.4 | 3.5 ~6.0 | 6.1 ~8.6 | 8.7 ~12.2 | 12.3 ~15.6 | 15.7 ~18.5 | 18.6 ~21.4 | 21.5~ |
| E | 1 | 1 | 0 | 0 | 0 | 0 | 0 | 0 |

IMAGE FORMING APPARATUS

BACKGROUND OF THE INVENTION

Field of the Invention

The present invention relates to an image forming apparatus such as a copying machine, a printer, a facsimile machine, or a multifunction device equipped with such multiple functions.

Description of the Related Art

An image forming apparatus that is equipped with a developing unit accommodating developer containing toner and carrier, i.e., two-component developer, to develop an electrostatic image formed on a photosensitive drum serving as an image bearing member is used widely. In such an image forming apparatus, a toner density, i.e., ratio of toner to developer, in the developing unit is detected by an inductance sensor serving as a toner density detection unit to adjust the toner density so as to maintain a toner charge quantity in the developing unit to a constant level.

Specifically, a patch image serving as a toner image for control is formed, a target toner density is set based on a patch image density and a reference density, and supply of toner to the developing unit is controlled so that the toner density is set to a target toner density. Further, the target toner density has an upper limit value and a lower limit value, and the target toner density is set within that range.

However, there are cases where the target toner density is maintained at the upper limit value or the lower limit value, and in that case, if the toner charge quantity is varied more than expected, there is a risk that image quality may be deteriorated. Therefore, a control of adjusting transfer current at a secondary transfer portion based on patch image density in a case where the target toner density is maintained at the upper limit value or the lower limit value has been proposed (Japanese Patent Application Laid-Open Publication No. 2018-010143). The secondary transfer portion is a portion where the toner image transferred from the photosensitive drum to the intermediate transfer belt is further transferred from the intermediate transfer belt to the recording material.

Recently, there are attempts to reduce the amount of developer accommodated in the developing unit to cut down initial costs. According to such a developing unit, even if the target toner density is maintained within the range of the upper limit value and the lower limit value, the toner charge quantity tends to vary more than expected, and in that case, the image quality may be deteriorated.

SUMMARY OF THE INVENTION

The present invention provides a configuration where deterioration of image quality can be suppressed even if the amount of developer accommodated in the developing unit is small.

According to a first aspect of the present invention, an image forming apparatus includes an image bearing member configured to bear an electrostatic image, a developing unit configured to accommodate developer containing toner and carrier, and develop the electrostatic image formed on the image bearing member by toner as a toner image, a toner supply unit configured to supply toner to the developing unit, a toner density detection sensor configured to detect information related to a toner density in the developing unit, an intermediate transfer belt to which the toner image is primarily transferred from the image bearing member, a secondary transfer member configured to perform secondary transfer of the toner image on the intermediate transfer belt to a recording material, a power supply configured to apply voltage to the secondary transfer member, a control unit configured to control a supply quantity of toner from the toner supply unit to the developing unit based on the toner density detected by the toner density detection sensor and a target toner density, and perform constant voltage control so that a voltage applied from the power supply to the secondary transfer member is set to a target transfer bias to supply a target transfer current to the secondary transfer member, and, an image density detection sensor configured to detect an image density of a toner image for control transferred from the image bearing member to the intermediate transfer belt. During a continuous image forming job, the control unit is configured to execute a mode of detecting the image density of the toner image for control in which the toner image for control is transferred to an area of the intermediate transfer belt between a first recording material and a second recording material succeeding the first recording material and the image density of the toner image for control is detected by the image density detection sensor, and in a case where the image density detected in the mode is higher by a predetermined threshold or more than a reference density, the control unit is configured to set the target toner density so that the target toner density becomes smaller than before execution of the mode and also set the target transfer current so that the target transfer current set for transfer to the second recording material becomes smaller than the target transfer current set for transfer to the first recording material.

According to a second aspect of the present invention, an image forming apparatus includes an image bearing member configured to bear an electrostatic image, a developing unit configured to accommodate developer containing toner and carrier, and develop the electrostatic image formed on the image bearing member by toner as a toner image, a toner supply unit configured to supply toner to the developing unit, a toner density detection sensor configured to detect information related to a toner density in the developing unit, an intermediate transfer belt to which the toner image is primarily transferred from the image bearing member, a secondary transfer member configured to perform secondary transfer of the toner image on the intermediate transfer belt to a recording material, a power supply configured to apply voltage to the secondary transfer member, a control unit configured to control a supply quantity of toner from the toner supply unit to the developing unit based on the toner density detected by the toner density detection sensor and a target toner density, and control the power supply so that a voltage applied to the secondary transfer member from the power supply is set to a target transfer bias, and, an image density detection sensor configured to detect an image density of a toner image for control transferred from the image bearing member to the intermediate transfer belt. During a continuous image forming job, the control unit is configured to execute a mode of detecting the image density of the toner image for control in which the toner image for control is transferred to an area of the intermediate transfer belt between a first recording material and a second recording material succeeding the first recording material and the image density of the toner image for control is detected by the image density detection sensor, and in a case where the image density detected in the mode is higher by a predetermined threshold or more than a reference density, the control unit is configured to set the target toner density so that the target toner density becomes smaller than before execution of the mode and also sets the target transfer bias so that the target transfer bias set for transfer to the second recording material becomes smaller than the target transfer bias set for transfer to the first recording material.

Further features of the present invention will become apparent from the following description of exemplary embodiments with reference to the attached drawings.

BRIEF DESCRIPTION OF THE DRAWINGS

FIG. 4 shows a determination table of toner charge quantity according to the embodiment.

FIG. 5 shows a table of thresholds of patch image density with respect to relative humidity according to the embodiment.

FIG. 6 is a table of constants of proportionality and intercepts with respect to processing speed for obtaining a correction coefficient of secondary transfer target current according to the embodiment.

FIG. 7 is a table of constants with respect to environment sections to obtain a correction coefficient of the secondary transfer target current according to the embodiment.

DESCRIPTION OF THE EMBODIMENTS

The present embodiment will be described with reference to FIGS. 1 to 8. The present embodiment describes a tandem-type full-color printer as an example of an image forming apparatus 1. However, the present invention is not limited to the tandem-type image forming apparatus 1, and it is applicable to other types of image forming apparatuses or to monochrome or mono-color printers instead of full-color printers. The present embodiment can further be applied to various uses, such as printers, various types of printing machines, copying machines, facsimiles machines and multifunction machines.

Image Forming Apparatus

Figure 1:
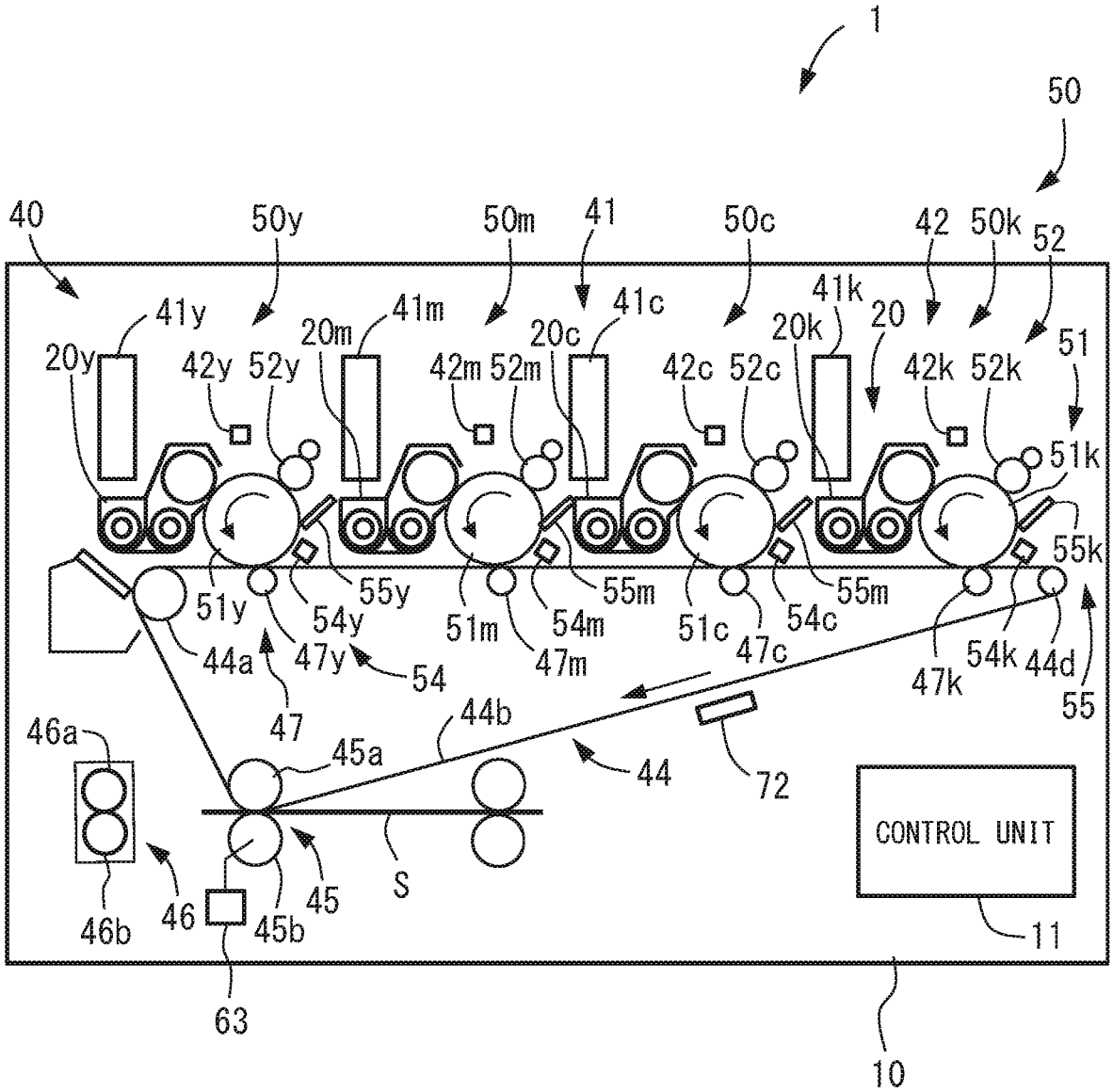
FIG. 1 is a schematic cross-sectional view of an image forming apparatus according to an embodiment.

As illustrated in FIG. 1, the image forming apparatus 1 includes an apparatus body 10, a sheet feeding unit (not shown), an image forming portion 40, a sheet discharge portion (not shown), and a control unit 11. The image forming apparatus 1 can form a four-color full-color image on a recording material in response to an image signal from a document reading apparatus (not shown), a host device such as a personal computer, or an external apparatus such as a digital camera or a smartphone. Actual examples of a sheet S serving as the recording material to which toner image is formed include thin paper, normal paper, thick paper, synthetic resin sheets, and OHP sheets.

The image forming portion 40 can form an image based on image information to a sheet S fed from the sheet feeding unit. The image forming portion 40 includes image forming units 50*y*, 50*m*, 50*c* and 50*k*, toner bottles 41*y*, 41*m*, 41*c* and 41*k*, exposing units 42*y*, 42*m*, 42*c* and 42*k*, an intermediate transfer unit 44, a secondary transfer portion 45, and a fixing unit 46. The image forming apparatus 1 according to the present embodiment corresponds to a full-color image, and the image forming units 50*y*, 50*m*, 50*c* and 50*k* are provided independently with a similar configuration for each of the four toner colors of yellow (y), magenta (m), cyan (c) and black (k). The respective configurations for the four colors are denoted by assigning color identifiers after the same reference numbers in FIG. 1, but in FIGS. 2 and 3 or in the specification, the configurations may be illustrated only by reference numbers without the color identifiers.

An image forming unit 50 includes a photosensitive drum 51 serving as an image bearing member for forming a toner image, a charging roller 52, a developing unit 20, a pre-exposure device 54, and a regulation blade 55. The image forming unit 50 is formed integrally as a unit serving as a processing cartridge which can be detachably attached to the apparatus body 10.

The photosensitive drum 51 is configured to rotate and bear an electrostatic image used for forming images. According to the present embodiment, the photosensitive drum 51 is an organic photoreceptor (OPC) having negative chargeability and an outer diameter of 30 mm, and for example, it is driven to rotate in an arrow direction at a processing speed, or peripheral speed, of 210 mm/sec. The photosensitive drum 51 includes an aluminum cylinder as a base, and three surface layers, which are an undercoating layer, an optical charge generating layer, and a charge transport layer, laminated by being applied on the surface of the base in the named order. According to the image forming apparatus 1 of the present embodiment, the processing speed is variable.

Figure 2:
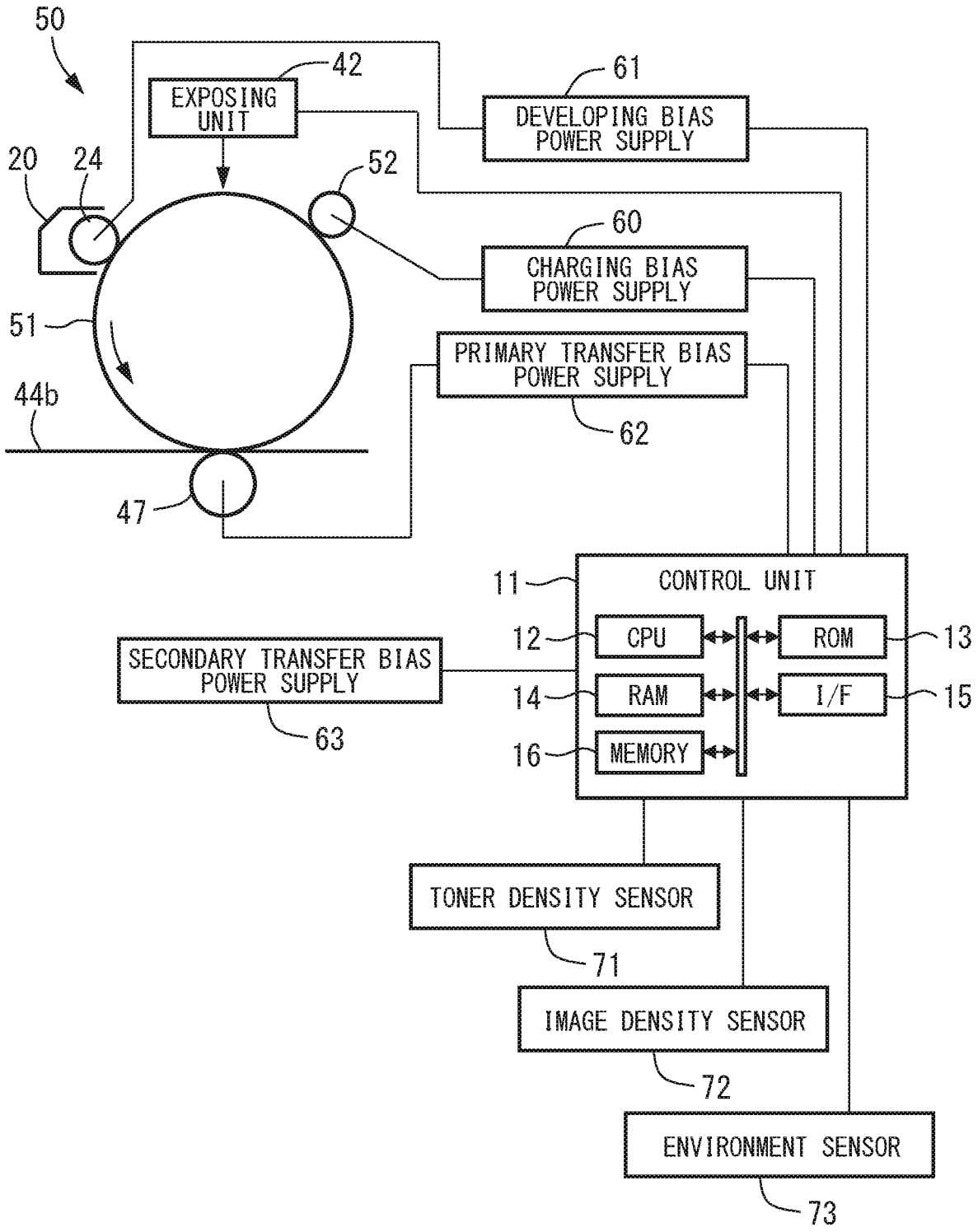
FIG. 2 is a cross-sectional view illustrating a schematic configuration of a photosensitive drum and surrounding mechanisms according to the embodiment.

As illustrated in FIG. 2, the charging roller 52 adopts a rubber roller that contacts the surface of the photosensitive drum 51 and is driven to rotate following the rotation thereof, thereby charging the surface of the photosensitive drum 51 uniformly. A charging bias power supply 60 is connected to the charging roller 52. The charging bias power supply 60 applies DC voltage as charging bias to the charging roller 52 and charges the photosensitive drum 51 via the charging roller 52.

An exposing unit 42 is a laser scanner that emits laser light according to image information of separated colors output from the control unit 11 and exposes the surface of the charged photosensitive drum 51 to form an electrostatic image. In a state where developing bias is applied, the developing unit 20 develops the electrostatic image formed on the photosensitive drum 51 using toner and forms a toner image. A developing bias power supply 61 for applying developing bias is connected to the developing unit 20. The details of the developing unit 20 will be described later.

The toner image developed by the photosensitive drum 51 is primarily transferred to an intermediate transfer belt 44*b* to be described later. As illustrated in FIG. 1, after primary transfer, the surface of the photosensitive drum 51 is destaticized by the pre-exposure device 54. The regulation blade 55 is a counter blade, which is an elastic blade mainly made of urethane, having a blade free length of 8 mm, and which is abutted against the photosensitive drum 51 by a predetermined pressing force.

The intermediate transfer unit 44 includes a plurality of rollers such as a driving roller 44*a*, a driven roller 44*d*, and primary transfer rollers 47*y*, 47*m*, 47*c* and 47*k*, and the intermediate transfer belt 44*b* wound around, or stretched across, these rollers to bear the toner image. The primary transfer rollers 47*y*, 47*m*, 47*c* and 47*k* are respectively arranged in an opposed manner to photosensitive drums 51*y*, 51*m*, 51*c*, and 51*k* and abut against the intermediate transfer belt 44*b*. A primary transfer bias power supply 62 for applying primary transfer bias is connected to the primary transfer roller 47 (refer to FIG. 2).

The intermediate transfer belt 44*b* serving as an intermediate transfer body abuts against the photosensitive drum 51 and forms a primary transfer portion between the photosensitive drum 51, and by having a primary transfer bias applied thereto, the toner image formed on the photosensitive drum 51 is primarily transferred at the primary transfer portion. By applying a primary transfer bias having positive polarity to the intermediate transfer belt 44*b* from the primary transfer roller 47, the respective toner images having negative polarity on the photosensitive drums 51 are sequentially transferred to form multiple layers on the intermediate transfer belt 44*b*. An image density sensor 72 serving as an image density detection unit for detecting the image density of a patch image serving as a toner image for control is arranged opposing the intermediate transfer belt 44*b*.

The secondary transfer portion 45 includes a secondary transfer inner roller 45*a* serving as an inner roller and a secondary transfer outer roller 45*b* serving as a secondary transfer member or an outer roller. The secondary transfer inner roller 45*a* contacts an inner surface of the intermediate transfer belt 44*b* and stretches the intermediate transfer belt 44*b*. A secondary transfer bias power supply 63 serving as power supply for applying secondary transfer bias is connected to the secondary transfer outer roller 45*b*. By applying secondary transfer bias having positive polarity to the secondary transfer outer roller 45*b*, a full-color toner image formed on the intermediate transfer belt 44*b* is transferred to the sheet S. The secondary transfer outer roller 45*b* abuts against an outer circumferential surface of the intermediate transfer belt 44*b* stretched across the secondary transfer inner roller 45*a* and forms the secondary transfer portion 45 with the intermediate transfer belt 44*b*. In a state where the secondary transfer bias is applied, the toner image primarily transferred to the intermediate transfer belt 44*b* is secondarily transferred to the sheet S at the secondary transfer portion 45. In the present embodiment, a configuration where the secondary transfer bias is applied to the secondary transfer outer roller 45*b* is described as an example, but it is also possible to have the secondary transfer bias applied to the secondary transfer inner roller 45*a*.

The fixing unit 46 includes a fixing roller 46*a* and a pressure roller 46*b*. The sheet S is nipped and conveyed between the fixing roller 46*a* and the pressure roller 46*b*, by which the toner image transferred to the sheet S is heated, pressed, and fixed to the sheet S. After the image is fixed to the sheet S, the sheet discharge portion discharges the sheet S conveyed through the sheet discharge path through a sheet discharge port and places the sheet on the sheet discharge tray.

Developing Unit

Figure 3:
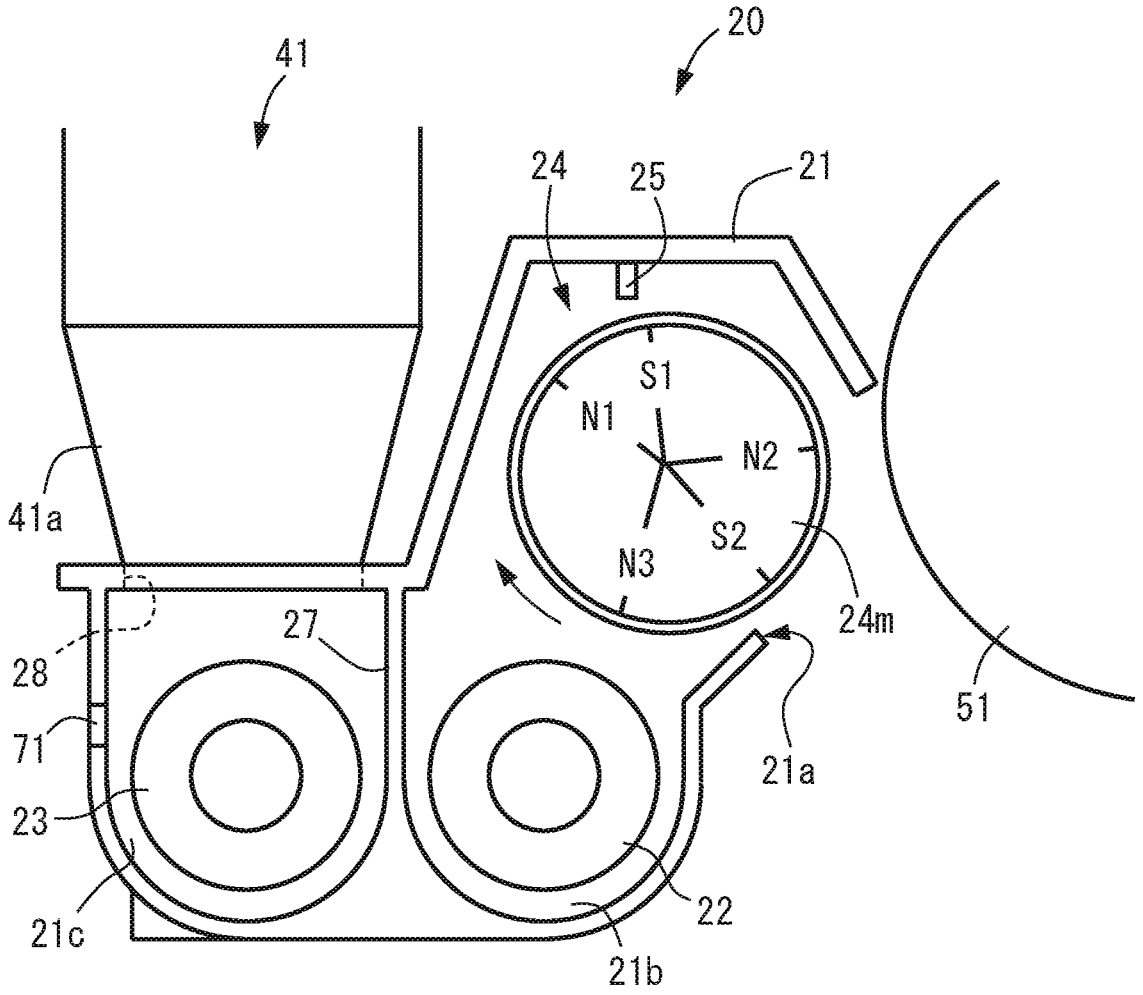
FIG. 3 is a schematic cross-sectional view of a developing unit according to the embodiment.

As illustrated in FIG. 3, the developing unit 20 includes a developer container 21 accommodating developer, a first conveyance screw 22, a second conveyance screw 23, a developing sleeve 24, a regulation member 25, and a toner density sensor 71. The developing unit 20 accommodates developer containing nonmagnetic toner and magnetic carrier, and develops the electrostatic image formed on the photosensitive drum 51 by developer. The developer container 21 includes an opening portion 21*a* through which the developing sleeve 24 is exposed at a position opposing the photosensitive drum 51.

The developer container 21 includes a partition wall 27 that extends in a longitudinal direction at an approximately center area. The developer container 21 is divided in an approximately horizontal direction by the partition wall 27 into a developing chamber 21*b* and an agitating chamber 21*c*. Developer is accommodated in the developing chamber 21*b* and the agitating chamber 21*c*. The partition wall 27 disposed between the developing chamber 21*b* and the agitating chamber 21*c* includes two communicating portions (not shown) for mutually communicating the developing chamber 21*b* and the agitating chamber 21*c* at both ends in the rotational axis direction of the developing sleeve 24. The developing chamber 21*b* supplies developer to the developing sleeve 24 and also collects developer from the developing sleeve 24. The agitating chamber 21*c* agitates the developer sent from the developing chamber 21*b* via the communicating portion (not shown) with replenished developer replenished to the developer container 21.

The first conveyance screw 22 is arranged approximately in parallel with the developing sleeve 24 along the rotational axis direction of the developing sleeve 24 in the developing chamber 21*b* to agitate and convey the developer in the developing chamber 21*b*. The second conveyance screw 23 is arranged approximately in parallel with the rotational axis direction of the first conveyance screw 22 in the agitating chamber 21*c* to convey the developer in the agitating chamber 21*c* in an opposite direction as the first conveyance screw 22. That is, the developing chamber 21*b* and the agitating chamber 21*c* constitute a developer circulation path for agitating and conveying developer. Toner is rubbed against the carrier by being agitated by the screws 22 and 23 and charged to negative polarity by friction. Further, a return screw (not shown) that conveys developer in an opposite direction is provided at a downstream end in the conveyance direction of the second conveyance screw 23. In the agitating chamber 21*c*, a large portion of developer conveyed from the upstream direction is pushed back by a return screw and conveyed from the communicating portion to the developing chamber 21*b*. The developing sleeve 24 and conveyance screws 22 and 23 are connected by a gear mechanism (not shown) outside the developer container 21 and driven to rotate integrally by a common drive motor.

In the agitating chamber 21*c*, a supply port 28 opened upward is formed at an upstream end in a developer conveyance direction, and a hopper 41*a* of a toner bottle, i.e., toner supply unit, 41 is connected to the supply port 28. The toner bottle 41 can supply toner to the developing unit 20, and the toner supplied from the toner bottle 41 is supplied through the hopper 41*a* and via the supply port 28 to the agitating chamber 21*c*. A screw is arranged at a lower portion in the toner bottle 41, and toner accommodated in the toner bottle 41 is supplied to the agitating chamber 21*c* by the rotation of the screw. The screw is driven using the motor controlled by the control unit 11 as a driving source.

The developing sleeve 24 bears developer containing nonmagnetic toner and magnetic carrier and conveys the same to a developing area opposing the photosensitive drum 51. The developing sleeve 24 is made of a nonmagnetic material such as aluminum or nonmagnetic stainless steel, and in the present embodiment, it is made of aluminum. On the inner side of the developing sleeve 24 is arranged a roller-shaped magnet roller, i.e., magnetic field generation unit, 24*m* in a manner fixed in a non-rotating state with respect to the developer container 21. The magnet roller 24*m* has a plurality of magnetic poles N1, S1, N2, S2, and N3 on the surface thereof.

The toner density sensor, i.e., toner density detecting unit, 71 is provided on a side wall of the agitating chamber 21*c* to detect the developer in the developer container 21 and output a signal corresponding to the ratio of toner to developer to thereby detect information related to toner density.

According to the present embodiment, the toner density sensor 71 is an inductance sensor, and it outputs a signal corresponding to the ratio of carrier to developer. That is, according to the two-component developer, the permeability is increased if the percentage of carrier is increased. Therefore, the inductance sensor detects permeability and outputs a signal corresponding to the toner density. Accordingly, the increase of output value of the inductance sensor shows that the toner density has dropped, and the drop of output value of the induction sensor indicates that the toner density has increased. The toner density refers to a ratio of toner weight to a total weight of carrier and toner, and in the following description, it is also referred to as TD ratio. The output value of the toner density sensor 71 is also referred to as inductance information.

Developer composed mainly of toner and carrier is accommodated in the developer container 21, and the ratio shown by toner weight to developer, i.e., toner density or TD ratio, in the initial state is approximately 8%. The TD ratio should be appropriately adjusted according to toner charge quantity, carrier particle size and structure of the developing unit 20, for example, and it is not limited to 8%.

The developing bias power supply 61 (refer to FIG. 2) applies an oscillation voltage having superposed an AC voltage to a DC voltage Vdc having negative polarity to the developing sleeve 24. The developing sleeve 24 to which the DC voltage Vdc having negative polarity is applied has a relatively negative polarity with respect to the electrostatic image formed on the photosensitive drum 51, and the toner charged to negative polarity in the developer is transferred from the developing sleeve 24 to the photosensitive drum 51. The remaining developer after developing the electrostatic image on the developing sleeve 24 is collected in the developer container 21 by the rotation of the developing sleeve 24 and mixed with the developer conveyed by the conveyance screw 22.

Control Configuration

As illustrated in FIG. 2, the control unit 11 is composed of a computer, and includes, for example, a CPU 12, a ROM 13 that stores programs for controlling various units, a RAM 14 that stores data temporarily, and an input-output circuit (I/F) 15 that inputs and outputs signals to and from the exterior. Further, the control unit 11 includes a memory 16 serving as a storage capable of storing various data such as a patch image density described later. The CPU 12 is a microprocessor that controls the entire image forming apparatus 1, and it is a main constituent of a system controller. The CPU 12 is connected via the input-output circuit 15 to the sheet feeding unit, the image forming portion 40, and the sheet discharge portion, and communicates signals with various units and controls the operations thereof. The ROM 13 stores image forming control sequences and the like for forming an image on the sheet S and stores a secondary transfer high voltage table for determining a secondary transfer current or a secondary transfer voltage serving as secondary transfer bias based on environmental information, for example.

Further, the charging bias power supply 60, the developing bias power supply 61, the primary transfer bias power supply 62, the secondary transfer bias power supply 63, the toner density sensor 71, the image density sensor 72, and an environment sensor 73 are connected to the control unit 11. The control unit 11 controls a supply quantity of toner from the toner bottle 41 to the developing unit 20 based on a toner consumption quantity and a relationship between toner density detected by the toner density sensor 71 and target toner density. Along therewith, the control unit 11 can execute a patch detection ATR (Auto Toner Replenishing) control serving as a mode of transferring a patch image to the intermediate transfer belt 44*b* at a predetermined timing and detecting the image density of the patch image by the image density sensor 72. Then, the control unit 11 sets a target toner density based on the image density, i.e., patch image density, detected by patch detection ATR control and reference density. In the present embodiment, the reference density used during the patch detection ATR control is determined as follows. When a new developing unit is attached to the image forming apparatus, a patch image is formed under a predetermined development condition, and a detection result obtained by detecting the patch image by the image density sensor 72 is set as a reference, i.e., reference density.

Further, the control unit 11 sets a transfer condition at the primary transfer portion and the secondary transfer portion 45 based on sheet type information and the environmental information detected by the environment sensor 73. The environment sensor 73 serving as a humidity detection unit is a sensor for detecting temperature and humidity, and the control unit 11 can set the transfer condition based on the relative humidity detected by the environment sensor 73. The control unit 11 can also set the transfer condition based on the patch detection ATR control, the details of which will be described later.

Image Forming Operation

Next, an image forming operation by the image forming apparatus 1 configured in the above-mentioned manner will be described. When an image forming operation is started, at first, the photosensitive drum 51 is rotated and the surface is charged by the charging roller 52. Then, a laser light is emitted to the photosensitive drum 51 from the exposing unit 42 based on image information, and an electrostatic latent image is formed on the surface of the photosensitive drum 51. By adhering toner to the electrostatic latent image, the image is developed and visualized as a toner image, and thereafter transferred to the intermediate transfer belt 44*b*.

Meanwhile, in parallel with such toner image forming operation, the sheet S is fed, and the sheet S is conveyed to the secondary transfer portion 45 at a matched timing with the toner image on the intermediate transfer belt 44*b*. Further, the toner image is transferred to the sheet S from the intermediate transfer belt 44*b* and the sheet S is conveyed to the fixing unit 46, where the unfixed toner image is heated, pressed, and fixed to the surface of the sheet S before the sheet S is discharged from the apparatus body 10.

Toner Supply Control

Next, a control for supplying toner to the developing unit 20 in the image forming apparatus 1 according to the present embodiment will be described. A two-component developing system has various advantages such as stability of image quality and durability of apparatus compared to other developing systems. Meanwhile, by toner consumption, the TD ratio of developer within the developer container 21 is changed. As a result, by the change of toner charge quantity, the developer characteristics may be changed, and the output image density may be varied. Therefore, in order to maintain a constant image density of the image being formed, a toner supply control technique of accurately detecting the TD ratio of developer and the image density and supplying just the right amount of toner is put into practice.

In the present embodiment, a triple control system by inductance control, video count control, and patch detection ATR control is adopted to stabilize the output image density with a good balance. Inductance control is a system for controlling the toner supply quantity based on the toner density, i.e., inductance value or information, detected by the toner density sensor 71. Video count control is a control of toner supply based on a video count value or information. The video count value is a value having integrated levels (0 to 255 levels, for example) per each pixel of image data being entered corresponding to one sheet of image. The patch detection ATR control is a system for controlling the toner supply quantity by transferring the patch image to the intermediate transfer belt 44*b* as described above and detecting the patch image density by the image density sensor 72.

Therefore, at first, a control is performed to supply an amount of toner having been consumed by predicting the quantity of toner consumption by video count control in a feedforward manner, and then correcting a shift of toner density from a reference value by performing inductance control of a fluctuation of supply quantity via feedback control. This is because if only the video count control is performed, for example, in a case where the toner consumption quantity is high, detection delay caused by time difference from toner supply to the reaching of toner supplied by inductance control may lead to the toner density dropping more than expected. Therefore, determining a rough toner consumption quantity based on video count value information and performing correction based on the inductance information is preferable from the viewpoint of improving toner supply accuracy.

Further, a control to appropriately change the target toner density of inductance control is executed according to the patch image density acquired by patch detection ATR control. That is, even if the toner density is the same, it is well known that the carrier charge performance may be deteriorated by toner attaching to the surface of the carrier and gradually lowering the toner charge quantity during use. Therefore, it is preferable to change the target value of toner density by inductance control through infrequent execution of patch detection ATR.

According to the present embodiment, patch detection ATR control can be executed at a predetermined timing. For example, in a case where an image whose image coverage is below 20%, especially whose image coverage is approximately from 2 to 10%, is subjected to continuous printing of 1000 sheets, that is, in a case where a continuous image forming job is executed, patch detection ATR control is executed every 100 sheets set as the predetermined timing. In patch detection ATR control, density, such as toner density 1.0, of a patch image transferred to an area of the intermediate transfer belt 44*b* is detected by the image density sensor 72. That is, during the continuous image forming job, a patch image is transferred to an area of the intermediate transfer belt 44*b* between a position of the intermediate transfer belt 44*b* where a first toner image to be transferred to a first recording material is formed and a position where a second toner image to be transferred to a second recording material succeeding the first recording material is formed, and image density of the patch image is detected by the image density sensor 72. Then, whether the patch image density is greater than (patch sections 1 and 2 described later) or smaller than (patch sections 4 and 5 described later) the reference density or within a predetermined range (patch section 3 described later) is determined, and Vtrgt corresponding to target toner density of inductance control is updated. Vtrgt is also referred to as an inductance target value. Then, the toner supply quantity and frequency of toner supply are adjusted so that the toner density is converged to the updated target toner density before the execution of a subsequent patch detection ATR control. Further, the control of detecting the toner image density on the intermediate transfer belt 44*b* and correcting the target toner density of inductance control based on the detection result is performed repeatedly for the subsequent patch detection ATR control, similar to the previous execution.

Specifically, for example, if continuous image forming is performed with a high image coverage, such as an image coverage of 20% or greater, the amount of toner consumption within the developing unit is increased and the toner charge quantity tends to drop. If the toner charge quantity drops significantly, the Vtrgt which is the inductance target value determined by inductance control each time the patch detection ATR control is executed is set to a high value, that is, the TD ratio drops. If the toner charge quantity is low, the patch image density detected by patch detection ATR control becomes higher than the reference density (patch sections 1 and 2 described later). In this case, with the aim to increase the toner charge quantity within the developing unit, the target toner density is lowered, that is, the Vtrgt is increased, so that the percentage of toner within the developing unit is lowered. Thus, the chance of toner being in contact with the carrier is increased and the toner charge quantity can be increased.

Meanwhile, if continuous image forming is performed with a low image coverage, the amount of toner consumption within the developing unit is small and the toner charge quantity tends to rise. If the rise of toner charge quantity is significant, the Vtrgt which is the inductance target value determined by inductance control each time the patch detection ATR control is executed is set to a low value, that is, the TD ratio rises. If the toner charge quantity is high, the patch image density detected by patch detection ATR control becomes lower than the reference density (patch sections 4 and 5 mentioned later). In that case, in order to lower the toner charge quantity in the developing unit, the target toner density is raised, that is, the Vtrgt is lowered, so as to increase the percentage of toner within the developing unit. Thereby, the chance of toner being in contact with the carrier is reduced and the toner charge quantity can be lowered.

As described, if the patch image density detected by patch detection ATR control is higher than the reference density, the control unit 11 lowers the target toner density, that is, raises the Vtrgt. Control is performed to lower the target toner density as the patch image density increases. Further, if the patch image density detected by patch detection ATR control is lower than the reference density, the control unit 11 raises the target toner density, that is, lowers the Vtrgt. Control is performed to raise the target toner density as the patch image density becomes lower. If the patch image density detected by patch detection ATR control is within a proper range with respect to the reference density, the control unit 11 will not change the target toner density.

An upper limit value and a lower limit value are set for the inductance target value, and in patch detection ATR control, the inductance target value is set within this range. That is, based on the relationship between the patch image density and the reference density detected by patch detection ATR control, the target toner density is set within the range between the upper limit value and the lower limit value determined in advance. However, there are cases where the target toner density is maintained at the upper limit value or the lower limit value, and if the toner charge quantity is varied more than expected in that case, the image quality may be deteriorated. Therefore, also according to the present embodiment, in a case where the target toner density is maintained at the upper limit value or the lower limit value, the transfer current at the secondary transfer portion is adjusted based on the patch image density.

Control of Transfer Bias

According to the present embodiment, in addition to the control described above, the transfer bias at the secondary transfer portion is adjusted based on the patch image density even if the target toner density is not maintained at the upper limit value or the lower limit value. That is, according to the developing unit of the present embodiment, the amount of developer being accommodated is reduced with the aim to cut down initial costs. However, in such a developing unit, the toner charge quantity may be varied more than expected even if the target toner density falls within the range between the upper limit value and the lower limit value, and in that case, the image quality may be deteriorated.

If the amount of developer in the developing unit is sufficient, by performing the above-mentioned toner supply control, the toner charge quantity within the developing unit can be kept within the preferable range as long as the target toner density falls within the range between the upper limit value and the lower limit value.

Meanwhile, if the amount of developer in the developing unit is small, even if the target toner density is kept within the range between the upper limit value and the lower limit value and the above-mentioned control including the patch detection ATR control is performed, the toner charge quantity in the developing unit may fall out of the preferable range. For example, the toner charge quantity may fall out of the preferable range depending on the environment.

Specifically, it is known that the charge quantity of toner tends to drop in a high temperature and high humidity environment. If the amount of charge of toner drops in a high temperature and high humidity environment, the transfer current at the secondary transfer portion becomes excessive, by which a periodic toner transfer failure may occur in the conveyance direction of the recording material and the image quality may be deteriorated greatly. In contrast, in a low temperature and low humidity environment, the charge quantity of toner is known to increase easily. If the charge quantity of toner is increased in a low temperature and low humidity environment, transfer failure caused by lack of transfer current at the secondary transfer portion may occur and the image quality may be deteriorated greatly.

Therefore, according to the present embodiment, the control unit 11 sets the target toner density to be lower than the target toner density immediately before the execution of the patch detection ATR control if the patch image density detected by patch detection ATR control is higher than the predetermined amount (higher by a predetermined value or more than the reference density), and if the target toner density being set has not reached the lower limit value. At the same time, the control unit 11 sets the secondary transfer bias to be smaller than the secondary transfer bias immediately before execution of the patch detection ATR control. That is, if the target toner density has not reached the lower limit value, in other words, if the inductance target value has not reached an upper limit value (Vuplim), in a state where the patch image density is higher than a predetermined amount, the target toner density is set low, i.e., the inductance target value is set high. Along therewith, the secondary transfer bias is set so that the transfer current supplied to the secondary transfer portion, i.e., target transfer current, is reduced. In other words, the target transfer current is set so that the target transfer current set for transfer to the second recording material is smaller than the target transfer current set for transfer to the first recording material regarding the first and second recording materials during a continuous image forming job.

The patch image density being higher than the reference density means that the toner charge quantity is low. Therefore, as described in the above-mentioned patch detection ATR control, the inductance target value is set high so that the toner charge quantity in the developing unit becomes high. Meanwhile, if the toner charge quantity is lowered in the high temperature and high humidity environment as described above, the image quality may be deteriorated by the transfer current being excessive at the secondary transfer portion. Therefore, according to the present embodiment, the secondary transfer bias is set so that the transfer current flowing to the secondary transfer portion becomes small. In that case, by changing the above-mentioned predetermined quantity based on the relative humidity detected by the environment sensor 73, control is performed appropriately according to the environment. This will be described in detail later.

Meanwhile, if the patch image density detected by patch detection ATR control is lower than the predetermined quantity and the target toner density having been set has not reached the upper limit value, the control unit 11 raises the target toner density to be higher than the target toner density immediately before execution of the patch detection ATR control. Along therewith, the control unit 11 sets the secondary transfer bias to be higher than the secondary transfer bias immediately before execution of the patch detection ATR control. That is, if the target toner density has not reached the upper limit value, in other words, if the inductance target value has not reached the lower limit value (Vlowlim), the target toner density is set high, or inductance target value is set low, if the patch image density is lower than the predetermined quantity. Along therewith, the secondary transfer bias is set so that the transfer current flowing to the secondary transfer portion becomes high.

The patch image density being lower than the reference density means that the toner charge quantity is high. Therefore, as has been described in the above patch detection ATR control, the inductance target value is set low so as to lower the toner charge quantity in the developing unit. Meanwhile, if the charge quantity of toner is increased in the low temperature and low humidity environment as mentioned above, transfer current may become insufficient at the secondary transfer portion and the image quality may be deteriorated. Therefore, according to the present embodiment, the secondary transfer bias is set so that the transfer current flowing to the secondary transfer portion is increased. In that state, appropriate control according to the environment is performed by changing the above-mentioned predetermined quantity based on the relative humidity detected by the environment sensor 73. The details thereof will be described in detail later.

Details of Transfer Bias Control

At first, according to the present embodiment, the patch image density is divided into five sections, and the density is divided into the following sections with thresholds for the respective stages referred to as Qth1 to Qth4.

Qth1<patch image density: Section 1

Qth2<patch image density≤Qth1: Section 2

Qth3<patch image density≤Qth2: Section 3

Qth4<patch image density≤Qth3: Section 4

Patch image density<Qth4: Section 5

The patch image density acquired by patch detection ATR control is converted into the above-described sections, i.e., patch sections, and output.

The thresholds Qth1 to Qth4 are set according to the relative humidity detected by the environment sensor 73. The relationship between relative humidity (%) and respective thresholds Qth1 to Qth4 (V) are shown in FIG. 5. Qth1 to Qth4 are thresholds for the voltage value (V) output from the image density sensor 72. The voltage value (V) output from the image density sensor 72 corresponds to the patch image density, and the value increases toward the positive side as the image density becomes higher with respect to the reference density whereas the value increases toward the negative side as the image density, becomes lower with respect to the reference density. The reference density is a value set when the output value of the image density sensor 72 is 0 V.

Further, as can be seen from FIG. 5, the absolute value of Qth1 to Qth4 increases as the relative humidity decreases. This shows that the patch sections illustrated in FIG. 4 tend to be varied less as the relative humidity drops. Patch section 3 of FIG. 4 shows that the patch image density is within a proper range with respect to the reference density. For example, in a state where the relative humidity is 5%, patch section 3 is determined if the patch image density detected by the image density sensor 72 falls within the range of −60 V (Qth3)<patch image density<60 V (Qth2).

Meanwhile, in a state where the relative humidity is 5%, if the output value of the image density sensor 72 detecting the patch image density becomes greater than 60 V (Qth2), the patch section is changed from 3 to 2. In contrast, in a state where the relative humidity is 90%, if the output value of the image density sensor 72 detecting the patch image density becomes greater than 40 V (Qth2), the patch section is changed from 3 to 2.

Next, the Vtrgt which is the inductance target value is divided into the following three sections, with the upper limit value (lower limit value of target toner density) set as Vuplim and the lower limit value (upper limit value of target toner density) set as Vlowlim.

Vlowlim=Vtrgt: Section 1

Vlowlim<Vtrgt<Vuplim: Section 2

Vtrgt=Vuplim: Section 3

The Vtrgt acquired by inductance control is converted into the above-described sections, i.e., inductance sections, and output. Section 2 indicates that the inductance target value, i.e., target toner density, has not reached either the upper limit value or the lower limit value. Meanwhile, section 1 indicates that the inductance target value is maintained at the upper limit value, i.e., that the target toner density is maintained at the lower limit value, and section 3 indicates that the inductance target value is maintained at the lower limit value, i.e., that the target toner density is maintained at the upper limit value.

The above-mentioned patch section and inductance section are combined to determine the toner charge quantity in five stages based on a toner charge quantity determination table shown in FIG. 4, and the determination result is set as a determination result Q/m of toner charge quantity.

The determination of toner charge quantity is performed for each of the colors of yellow, magenta, cyan and black. Numerals 1 to 5 of the determination result shown in FIG. 4 are as follows.

Determination 1: Toner charge quantity is smaller than determination 2

Determination 2: Toner charge quantity is smaller than proper range

Determination 3: Toner charge quantity is within proper range

Determination 4: Toner charge quantity is greater than proper range

Determination 5: Toner charge quantity is greater than determination 4

For example, in a case where continuous image forming of an image having an image coverage of 20% or more is performed continuously, even if the inductance value is controlled to the inductance target value, there may be a case where the patch image density is greater than the reference density (patch image density of FIG. 4: section 1, Vtrgt: section 2). This indicates that since the carrier charge performance is significantly lowered, even if the Vtrgt is within section 2, the determination result of toner charge quantity is 4, which shows that toner charge quantity has become greater than the proper range. In a state where the toner charge quantity has become greater than the proper range, if the value in a normal secondary transfer current table is used in a low humidity environment, transfer unevenness, i.e., void, may occur in a single-color solid image.

Therefore, according to the present embodiment, correction coefficients α and β are calculated as described below based on the determination result of the toner charge quantity to acquire a correction coefficient γ of the secondary transfer current value, and the secondary transfer current is corrected. In the present embodiment, the secondary transfer bias is controlled by constant voltage control. Therefore, the secondary transfer current value, i.e., secondary transfer target current or target transfer bias, is set, and the voltage to be applied by the secondary transfer bias power supply 63 is set so that the determined secondary transfer target current is supplied.

Voltage setting is performed by executing ATVC (Active Transfer Voltage Control). In ATVC, multiple stages of voltages are applied when there is no sheet S at the secondary transfer portion, and the current value flowing through the secondary transfer portion at that time is measured. Then, based on the relationship between voltage and current, a voltage capable of supplying the secondary transfer target current to the secondary transfer portion is calculated. Further, it is also possible to control the secondary transfer bias by constant current control and perform control so that the secondary transfer current value controlled as above flows to the secondary transfer portion.

In any case, α and β mentioned above are calculated based on the following expression. At first, α is calculated based on the following expression:

$$\alpha = m_YMC \times Q/m_YMC + n_YMC$$

where "m_YMC" is a constant of proportionality determined by the processing speed, and "n_YMC" is an intercept value determined by the processing speed.

Further, "Q/m_YMC" is defined by:

$$Q/m_YMC = (Q/m_Y + Q/m_M + Q/m_C)/3$$

where "Q/m_Y" is the determination result of yellow toner charge quantity, "Q/m_M" is the determination result of magenta toner charge quantity, "Q/m_C" is the determination result of cyan toner charge quantity. That is, one of the numerals 1 to 5 showing the determination result illustrated in FIG. 4 is entered to Q/m_Y, Q/m_M and Q/m_C.

Next, β is calculated based on the following expression:

$$\beta = (m_K \times Q/m_K + n_K) \times E$$

where "m_K" is the constant of proportionality determined by processing speed, and "n_K" is the intercept value determined by processing speed. "Q/m_K" is the determination result of black toner charge quantity. "E" is the constant determined in advance for each environment section.

Values of m_YMC, n_YMC, m_K, and n_K are shown in FIG. 6. The relationship between environment section and E is shown in FIG. 7. In FIG. 7, the environment section is shown by the absolute moisture content (g/m$^3$). Further, the numerical value of the absolute moisture content of FIG. 7 shows that the stated numerical values are respectively included in the section, and for example, 3.5 to 6.0 of environment section 1 denotes that the moisture content is 3.5 or more and 6.0 or less.

The values of α and β calculated by the above-mentioned expression are used to compute the correction coefficient γ from the following expressions:

$$\text{if } \alpha \leq \beta: \gamma=(\alpha+\beta)/2$$

$$\text{if } \alpha > \beta: \gamma=\alpha$$

and the value of γ calculated above is used to correct the secondary transfer target current Itg by the following expression (Itg'):

$$Itg'=Itg\times\gamma$$

The following is an example of calculation of the secondary transfer target current. For example, a case is considered where the processing speed is set to 300 mm/s and the determination results (FIG. 4) of the toner charge quantities of all colors are the same. In that case, m_YMC=0.04, n_YMC=0.88, m_K=0.05, and n_K=0.5 is set according to FIG. 6. The value of E is 1 or 0 according to FIG. 7.

At first, if the determination results of all the colors are 3 (toner charge quantity is in proper range), the following is calculated.

$$Q/m_YMC=(Q/m_Y+Q/m_M+Q/m_C)/3=(3+3+3)/3=3$$

$$\alpha=m_YMC\times Q/m_YMC+n_YMC=0.04\times3+0.88=1$$

$$\beta=(m_K\times Q/m_K+n_K)\times E=(0.05\times3+0.5)\times E=0.65\times E$$

As described, since E is 1 or 0, β<1 is satisfied. Since α=1, α>β is satisfied, and γ=α=1 is realized. Therefore, in this case, correction of the secondary transfer target current will not be performed.

Next, if the determination results of all the colors are 2 (toner charge quantity is smaller than proper range), the following is calculated.

$$Q/m_YMC=(Q/m_Y+Q/m_M+Q/m_C)/3=(2+2+2)/3=2$$

$$\alpha=m_YMC\times Q/m_YMC+n_YMC=0.04\times2+0.88=0.96$$

$$\beta=(m_K\times Q/m_K+n_K)\times E=(0.05\times2+0.5)\times E=0.6\times E$$

Therefore, α=0.96 and β<α is satisfied, so that γ=α=0.96 is realized. Since γ<1, the secondary transfer target current is corrected to be smaller.

Next, if the determination results of all the colors are 4 (toner charge quantity is greater than proper range), the following is calculated.

$$Q/m_YMC=(Q/m_Y+Q/m_M+Q/m_C)/3=(4+4+4)/3=4$$

$$\alpha=m_YMC\times Q/m_YMC+n_YMC=0.04\times4+0.88=1.04$$

$$\beta=(m_K\times Q/m_K+n_K)\times E=(0.05\times4+0.5)\times E=0.7\times E$$

Therefore, α=1.04 and β<α is satisfied, so that γ=α=1.04 is realized. Since γ>1, the secondary transfer target current is corrected to be greater.

Now, the reason why α and β are classified to obtain γ will be described. In a case where a toner image of a secondary color, such as blue solid, formed by superposing color toners (yellow, magenta, and cyan) is transferred to the sheet S at the secondary transfer portion, it is usually preferable that the secondary transfer current is set high. Meanwhile, in a case where a toner image of a single black color is transferred to the sheet S at the secondary transfer portion, void tends to occur if the secondary transfer current is high. As described, the cause of image failure by the secondary transfer current differs between a toner image formed of a secondary color and a toner image formed of a single black color. Therefore, α and β are classified as above. The actual example will be illustrated below.

(1) In a low humidity environment, that is, in a state where the secondary transfer target current is high, and where the black toner charge quantity is relatively higher than the color toner charge quantity (if α≤β and E=1), the set value of γ will be β>γ=(α+β)/2>α. That is, by setting γ to be greater than α, the transfer property of the secondary color, such as blue solid, is guaranteed. Further by setting γ to be smaller than β, occurrence of void in a solid black image is suppressed.

(2) Cases Other than (1)

As described above, basically if the toner charge quantity of the respective colors is approximately the same, β<α is satisfied, and the secondary transfer target current is corrected to be greater or smaller in proportion to the magnitude of the toner charge quantity. Further, β<α is also satisfied if the toner charge quantity of color toner is relatively higher than the toner charge quantity of black toner. In this case, in order to suppress the occurrence of void in a black solid image, γ=β(<α) is preferable. However, in this case, the transfer property of the secondary color may be insufficient. Therefore, γ=α>β is set. This is because the transfer property of the secondary color is prioritized over suppression of occurrence of void in a solid black image.

Further according to the present embodiment, as can be recognized from FIG. 4, in a case where the set Vtrgt (target toner density) has reached the lower limit value or the upper limit value, the correction quantity of the secondary transfer target current is set to be greater compared to a case where it has not reached these values. At first, in a case where the patch image density detected by patch detection ATR control is higher than the predetermined quantity (patch sections 1 and 2 in FIG. 4), the control unit 11 corrects the secondary transfer target current as follows. At first, if the set Vtrgt has reached the Vuplim, the ratio in which the secondary transfer target current is reduced compared to that immediately before execution of the patch detection ATR control is set to be greater compared to a case where the set Vtrgt has not reached the Vuplim. In other words, if the target toner density has not reached the lower limit value, the ratio of reducing the transfer current set for transfer to the second recording material to the transfer current set for transfer to the first recording material is a first value, and the ratio of reducing the transfer current set for transfer to the second recording material to the transfer current set for transfer to the first recording material is a second value that is greater than the first value.

That is, in a case where the Vtrgt has reached the Vuplim (target toner density is the lower limit value), the inductance section of FIG. 4 is section 3, wherein in patch section 1, Q/m will be 5, and in patch section 2, Q/m will be 4. Meanwhile, if the Vtrgt has not reached the Vuplim, the induction section of FIG. 4 will be section 2, wherein in patch section 1, Q/m will be 4, and in patch section 2, Q/m will be 3. Therefore, in both patch sections 1 and 2, the determination numeral of Q/m will be greater in a case where the Vtrgt has reached the Vuplim, and the correction quantity of the secondary transfer target current will become greater.

Next, in a case where the patch image density detected by patch detection ATR control is lower than the predetermined quantity (patch sections 4 and 5 of FIG. 4), the control unit 11 will correct the secondary transfer target current as follows. At first, if the set Vtrgt has reached the Vlowlim, the ratio of increasing the secondary transfer target current from that immediately before execution of the patch detection ATR control is set greater compared to the case where the set Vtrgt has not reached the Vlowlim.

In other words if the Vtrgt has reached the Vlowlim (target toner density is upper limit value), the inductance section will be section 1 of FIG. 4, wherein in patch section 4, Q/m will be 2, and in patch section 5, Q/m will be 1. Meanwhile, if the Vtrgt has not reached the Vlowlim, the inductance section will be section 2 of FIG. 4, wherein in patch section 4, Q/m will be 3, and in patch section 5, Q/m will be 2. Therefore, in both patch sections 4 and 5, the determination number of Q/m will be smaller in a case where the Vtrgt has reached the Vlowlim, and the correction quantity of the secondary transfer target current will be set greater.

Further, as can be recognized from FIGS. 4 and 5, according to the present embodiment, whether to correct the secondary transfer target current, and further, the correction quantity thereof, is changed in response to the environment, that is, based on the relative humidity detected by the environment sensor 73. That is, based on FIG. 6, the thresholds Qth1 to Qth4 for varying the patch section according to the relative humidity is changed. Therefore, depending on the relative humidity, the patch section may be varied even if the patch image density detected by the image density sensor 72 is the same, and there occurs a case where the secondary transfer target current is corrected and a case where it is not corrected. Further, even in a case where the secondary transfer target current is corrected, the correction quantity thereof may differ.

As described above, in a case where the patch image density is higher than the predetermined quantity, or if it is lower than the predetermined quantity, the secondary transfer target current is corrected. The present embodiment changes the predetermined quantity according to relative humidity, so that even if the patch image density is the same, the secondary transfer target current may be corrected or not corrected.

That is, in a high humidity environment, the toner charge quantity tends to drop easily. If the toner charge quantity is low, the influence that the magnitude of the secondary transfer current has on the toner transfer property is great. Therefore, even if the amount of change of patch image density is small, image failure caused by transfer failure tends to occur unless the patch section is changed to correct the secondary transfer current.

Meanwhile, in a low humidity environment, the toner charge quantity tends to rise easily. If the toner charge quantity is high, the influence that the magnitude of the secondary transfer current has on the toner transfer property is small. Therefore, even if the amount of change of patch image density is small, the influence on the transfer property is small even if the patch section is changed to correct the secondary transfer current. Therefore, in the case where the amount of change of patch image density is great, the patch section is changed to correct the secondary transfer current.

Therefore, according to the present embodiment, in a case where the relative humidity detected by the environment sensor 73 is a first humidity, the control unit 11 sets the predetermined quantity to a first quantity (predetermined threshold is a first reference threshold). Meanwhile, in a case where the detected humidity detected by the environment sensor 73 is a second humidity lower than the first humidity, the control unit 11 sets the predetermined quantity to a second quantity that has a greater absolute value than the first quantity (predetermined threshold is a second reference threshold that is higher than the first reference threshold).

For example, if the relative humidity is 90%, in a case where the output value of detection by the image density sensor 72 detecting the patch image density becomes greater than 70 V (Qth1), the patch section is changed from 3 to 1. Therefore, in a case where the patch image density has been increased from 0 V corresponding to reference density to a value exceeding 70 V, even if the inductance section is 2, correction of the secondary transfer target current is performed. That is, if the patch image density becomes higher than the predetermined quantity, i.e., if the output value of the image density sensor 72 has exceeded 70 V, correction of the secondary transfer target current is performed even if the inductance target value has not reached the upper limit value. For example, the predetermined quantity at this time corresponds to the first quantity.

Meanwhile, if the relative humidity is 5%, in a case where the output value of the image density sensor 72 detecting the patch image density becomes greater than 110 V (Qth1), the patch section is changed from 3 to 1. Therefore, if the patch image density has been increased from 0 V corresponding to reference density to a value exceeding 110 V, even if the inductance section is 2, correction of the secondary transfer target current is performed. That is, if the patch image density becomes higher than the predetermined quantity, i.e., if the output value of the image density sensor 72 has exceeded 110 V, correction of the secondary transfer target current is performed even if the inductance target value has not reached the upper limit value. For example, assume the predetermined quantity corresponds to the second quantity. In a case where the relative humidity of 90% is set as the first humidity and the relative humidity of 5% is set as the second humidity, the absolute value of the second quantity is greater than the first quantity. The same applies in a case where the patch image density is lower than the predetermined quantity.

In a case where the image density detected during patch detection ATR control is higher than the first predetermined quantity and lower than the second predetermined quantity (for example, patch section 2), and where the set target toner density has not reached the lower limit value (Vuplim), the control unit 11 carries out the following process. That is, the control unit 11 reduces the target toner density than that immediate before execution of the patch detection ATR control, while setting the secondary transfer bias to a same value as that immediate before execution of the patch detection ATR control. In other words, in a case where the image density detected during patch detection ATR control is higher than the reference density by a second predetermined threshold that is smaller than the first predetermined threshold or more but not higher than the reference density by a first predetermined threshold or more, the target toner density is set so that the target toner density becomes smaller than before execution of patch detection ATR control, and the target transfer current is set so that the target transfer current set for transfer to the first recording material and the target transfer current set for transfer to the second recording material are the same. Further, in a case where the image density detected during patch detection ATR control is higher than the second predetermined quantity (such as patch section 1), and in a case where the set target toner density has not reached the lower limit value (Vuplim), the following control is performed. That is, the target toner density is set lower than the target toner density immediately before execution of patch detection ATR control, and the secondary transfer bias is set to be smaller than the secondary transfer bias immediately before execution of patch detection ATR control. In other words, if the image density detected during patch detection ATR control is higher than the reference density by a first predetermined threshold or more, the target toner density is set so that the target toner density becomes smaller than that before execution of patch detection ATR control, and also sets the target transfer current so that the target transfer current set for transfer of the second recording material becomes smaller than the target transfer current set for transfer of the first recording material.

Further, in a case where the image density detected during patch detection ATR control is lower than the first predetermined quantity and higher than the second predetermined quantity (such as patch section 4), and where the set target toner density has not reached the upper limit value (Vlowlim), the control unit 11 performs the following control. That is, the target toner density is set lower than the target toner density immediately before execution of patch detection ATR control, and meanwhile, the secondary transfer bias is set equal to the secondary transfer bias immediately before execution of the patch detection ATR control. Further, in a case where the image density detected during patch detection ATR control is lower than the second predetermined quantity (such as patch section 5), and where the set target toner density has not reached the upper limit value (Vlowlim), the following control is performed. The target toner density is set lower than the target toner density immediately before execution of patch detection ATR control, and meanwhile, the secondary transfer bias is set greater than the secondary transfer bias immediately before execution of patch detection ATR control.

Flow of Control Related to Correction of Secondary Transfer Target Current

Figure 8:
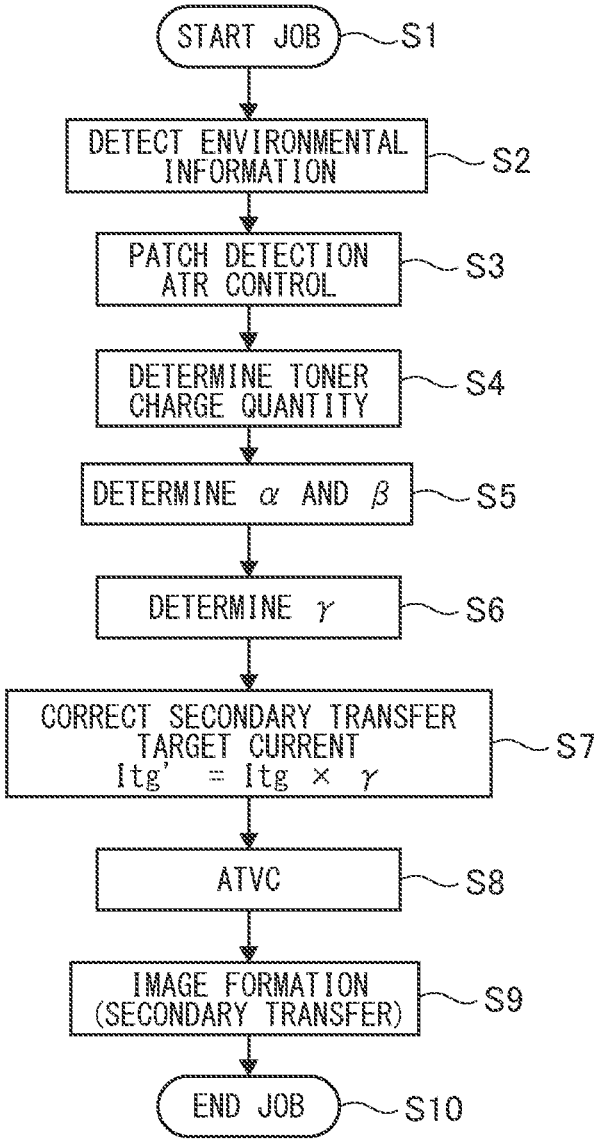
FIG. 8 is a flowchart of control regarding correction of secondary transfer target current according to the embodiment.

Next, an example of a control flow related to correction of the secondary transfer target current according to the present embodiment will be described with reference to FIG. 8. At first, when an image forming job is started (S1), the control unit 11 detects the environmental information by the environment sensor 73 (S2). As described, the environmental information is the relative humidity. The image forming job relates to forming an image (image forming) on the sheet S based on image data or a number of sheets on which image is to be formed entered by a command. Based on the relative humidity detected in S2 with reference to the table shown in FIG. 5, thresholds Qth1 to Qth4 of the patch section of FIG. 4 are determined.

Thereafter, a patch image is formed at a predetermined timing, and the patch detection ATR control in which the patch image density is detected by the image density sensor 72 is executed (S3). In this state, the patch image density and the reference density are compared to set the inductance target value. The setting of the inductance target value is performed based on the table for setting the inductance target value, regardless of the patch section of FIG. 4. Then, based on the patch image density detected by patch detection ATR control and the inductance section based on the inductance target value (Vtrgt) having been set, the control unit 11 performs determination of toner charge quantity based on the table of FIG. 4 (S4). In other words, Q/m is calculated for each of the colors.

The control unit 11 calculates the correction coefficients $\alpha$ and $\beta$ as described above, based on the Q/m of the respective colors and the tables of FIGS. 6 and 7 (S5). Further, the correction coefficient $\gamma$ is determined using the determined $\alpha$ and $\beta$ (S6). Then, using $\gamma$, the secondary transfer target current is corrected according to the expression of $Itg'=Itg\times\gamma$ (S7). Next, ATVC is performed based on Itg', and the voltage, i.e., secondary transfer voltage, to be applied to the secondary transfer portion is determined (S8). Thereafter, formation of image (image formation) is performed, and based on the determined secondary transfer voltage, the toner image is secondarily transferred to the sheet S (S9). After forming of all images of the image forming job has been performed, the image forming job is ended (S10).

The patch detection ATR control described above is performed during the image forming job, and when the secondary transfer target current is corrected based on the patch detection ATR control, the corrected secondary transfer target current is used from the forming of image to the subsequent sheet.

Further, in a state where the current image forming job is ended and the subsequent image forming job is started, the patch image density value detected by the above-mentioned patch detection ATR control is handed over. That is, until the subsequent patch detection ATR control is performed, the patch image density detected by the previous patch detection ATR control is used. Therefore, the patch image density detected by patch detection ATR control is stored in the memory 16 serving as the storage (FIG. 2). The memory 16 also stores the inductance target value set by patch detection ATR control. The patch image density and the inductance target value stored in the memory 16 are updated every time the patch detection ATR control is performed.

Then, when starting the image forming job, the control unit 11 sets the secondary transfer target current based on a relationship between the patch image density detected by the previous patch detection ATR control stored in the memory 16 and a predetermined quantity set based on the environment sensor 73. That is, when starting the image forming job, the environmental information is detected by the environment sensor 73, and based on the table illustrated in FIG. 5, thresholds Qth1 to Qth4 of the patch sections illustrated in FIG. 4 are determined. Then, using the patch image density and the inductance target value stored in the memory 16, determination of toner charge quantity is performed based on the table of FIG. 4. The values of $\alpha$, $\beta$ and $\gamma$ are calculated, and the secondary transfer target current is corrected. That is, in the subsequent image forming job, a flow illustrated in FIG. 8 excluding S3 is performed. Thereby, even according to the subsequent image forming job, an appropriate secondary transfer target current according to the environment can be set.

According to the image forming apparatus 1 of the present embodiment, even when the target toner density, i.e., inductance target value, has not reached the upper limit value or the lower limit value, the deterioration of image quality can be suppressed. Therefore, even in a state where the inductance target value is not maintained at the upper limit value or the lower limit value, the toner charge quantity is varied more than expected according to the environment, for example, by which transfer failure may occur at the secondary transfer portion and the image quality may be deteriorated. In contrast, according to the present embodiment, the toner charge quantity is determined based on the patch image density detected by patch detection ATR control, and the secondary transfer target current, i.e., transfer bias, is corrected. Therefore, an appropriate secondary transfer target current can be set in response to the change of toner charge quantity based on the environment and the like, to thereby suppress the occurrence of transfer failure and suppress the deterioration of image quality.

Other Embodiments

According to the embodiment described above, the correction quantity of the secondary transfer target current is set greater in a state where the inductance target value has reached the upper limit value or the lower limit value compared to a case where the inductance target value has not reached those values. However, the correction quantity of the secondary transfer target current can be changed in response to the difference between the inductance value, i.e., toner density, and the inductance target value, i.e., target toner density at that time. At first, if the patch image density detected by patch detection ATR control is higher than the predetermined quantity, the following process is performed. A case where the difference between the inductance value set after executing patch detection ATR control, i.e., latest inductance target value, and the inductance value at that time detected by the toner density sensor 71 is a first value, and a case where it is a second value that is smaller than the first value, are considered. In that case, if the difference is the first value, the ratio of reducing the secondary transfer target current with respect to that immediately before execution of patch detection ATR control is increased compared to the case where the difference is the second value. Real-time detection of the inductance value is performed. Therefore, the detection result of the inductance value that is updated each time detection is performed and the latest inductance target value, i.e., target toner density, are compared, and if the difference thereof is zero, or if the difference is smaller than a predetermined quantity, the correction quantity of the secondary transfer target current can be set to zero.

Next, in a case where the patch image density detected by patch detection ATR control is lower than the predetermined quantity, the following process is performed. That is, a case where the difference between the inductance value set after executing patch detection ATR control and the inductance value detected by the toner density sensor 71 at that time is a first value, and a case where it is a second value that is smaller than the first value, are considered. In that case, if the difference is the first value, the ratio of increasing the secondary transfer target current with respect to that immediately before execution of patch detection ATR control is increased compared to the case where the difference is the second value.

Further, according to the above-mentioned embodiment, the correction value of the secondary transfer target current is set based on the detected patch image density, but the present technique is not limited thereto. For example, a similar control can be applied to the primary transfer current which is the transfer bias applied at the primary transfer portion. In that case, image forming units, or stations, 50*y*, 50*m*, 50*c*, and 50*k* of respective colors are each subjected to toner charge quantity determination, and the target value of primary transfer current, that is, primary transfer target current, is corrected in a similar manner as described above. In this case, the determination result of toner charge quantity of each color is entered to the expression of $\alpha$. That is, "Q/m_YMC" will be Q/m_Y, Q/m_M, and Q/m_C, respectively. Further, "m_YMC" and "n_YMC" can be used in common in all the colors or they can be set respectively.

Now, a drawback may occur in which a portion of the toner image having been transferred to the intermediate transfer belt 44*b* is re-transferred to the photosensitive drum of a downstream-side station at the primary transfer portion of the station arranged downstream in the direction of rotation of the intermediate transfer belt 44*b*. Especially during deterioration of toner charge quantity, the re-transfer quantity is increased. That is, in a case where the toner charge quantity is lowered, the toner image is subjected to polarity inversion by discharge received during passing of the primary transfer portion of a station arranged downstream, and a phenomenon in which toner is adhered to the photosensitive drum in the station arranged downstream thereof becomes more significant.

Therefore, as described above, the primary transfer target current is corrected in response to the determination result of the toner charge quantity as described above to thereby suppress transfer failures such as re-transfer. For example, the re-transfer toner quantity can be reduced by determining reduction of toner charge quantity and lowering the current at the primary transfer portion of the downstream-side station, according to which both color variation and increase of the amount of toner consumption can be suppressed.

Further according to the present embodiment, the image forming apparatus 1 includes the intermediate transfer belt 44*b*, and after primarily transferring toner images of respective colors from the photosensitive drum 51 to the intermediate transfer belt 44*b*, the superposed color toner images are collectively secondarily transferred to the sheet S. However, the present technique is not limited thereto, and a method can be adopted in which the images are transferred directly from the photosensitive drums to the sheet conveyed via a sheet conveyance belt. In that case, the control unit 11 sets the correction values similar to the correction of transfer currents at the above-mentioned primary transfer portions.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-172575, filed Oct. 13, 2020, which is hereby incorporated by reference herein in its entirety.

What is claimed is:

1. An image forming apparatus comprising:

an image bearing member configured to bear an electrostatic image;

a developing unit configured to accommodate developer containing toner and carrier, and develop the electrostatic image formed on the image bearing member with toner into a toner image;

a toner supply unit configured to supply toner to the developing unit;

a toner density detection sensor configured to detect information related to a toner density in the developing unit;

an intermediate transfer belt to which the toner image is primarily transferred from the image bearing member;

a secondary transfer member configured to perform secondary transfer of the toner image on the intermediate transfer belt to a recording material;

a power supply configured to apply voltage to the secondary transfer member;

a control unit configured to control a supply quantity of toner from the toner supply unit to the developing unit based on the toner density detected by the toner density detection sensor and a target toner density, and perform constant voltage control so that a voltage applied from the power supply to the secondary transfer member is set to a target transfer bias to supply a target transfer current to the secondary transfer member; and an image density detection sensor configured to detect an image density of a toner image for control transferred from the image bearing member to the intermediate transfer belt, wherein, during a continuous image forming job, the control unit is configured to execute a mode of detecting the image density of the toner image for control in which the toner image for control is transferred to an area of the intermediate transfer belt between a position corresponding to a first recording material and a position corresponding to a second recording material succeeding the first recording material and the image density of the toner image for control is detected by the image density detection sensor, and in a case where the image density detected in the mode is higher by a predetermined threshold or more than a reference density, the control unit is configured to set the target toner density so that the target toner density becomes lower than that before execution of the mode and also set the target transfer current so that the target transfer current set for transfer to the second recording material becomes lower than the target transfer current set for transfer to the first recording material.

2. The image forming apparatus according to claim 1, wherein the predetermined threshold is a first predetermined threshold, and in a case where the image density detected in the mode is higher than the reference density by a second predetermined threshold which is lower than the first predetermined threshold or more, and not higher than the reference density by the first predetermined threshold, the control unit is configured to set the target toner density so that the target toner density is lower than that before the execution of the mode and also set the target transfer current so that the target transfer current set for transfer to the first recording material and the target transfer current set for transfer to the second recording material are the same.

3. The image forming apparatus according to claim 1, wherein the control unit is configured to set the target toner density within a range between an upper limit value and a lower limit value set in advance, based on the image density detected in the mode and the reference density, and in a case where the image density detected in the mode is higher than the reference density by the predetermined threshold or more, if the target toner density has not reached the lower limit value, a ratio of reducing the transfer current set for transfer of the second recording material with respect to the transfer current set for transfer of the first recording material is a first value, and if the target toner density has reached the lower limit value, a ratio of reducing the transfer current set for transfer of the second recording material with respect to the transfer current set for transfer of the first recording material is a second value that is greater than the first value.

4. The image forming apparatus according to claim 1, further comprising a humidity detection sensor configured to detect a relative humidity, wherein in a case where a detected humidity detected by the humidity detection sensor is a first humidity, the control unit is configured to set the predetermined threshold to a first reference threshold, and in a case where the detected humidity is a second humidity that is lower than the first humidity, the control unit is configured to set the predetermined threshold to a second reference threshold that is higher than the first reference threshold.

5. The image forming apparatus according to claim 4, further comprising a storage configured to store an image density detected in the mode, wherein when starting the image forming job, the control unit is configured to set the target transfer bias based on a relationship between an image density detected in the mode performed previously and stored in the storage and the predetermined threshold set based on the detected humidity.

6. The image forming apparatus according to claim 1, wherein the control unit is configured to determine an amount of change of the target transfer current set for transfer of the second recording material with respect to the target transfer current set for transfer of the first recording material based on a rotational speed of the image bearing member set for image forming.

7. The image forming apparatus according to claim 1, wherein the secondary transfer member is a secondary transfer inner roller configured to contact an inner side of the intermediate transfer belt and stretch the intermediate transfer belt, and the power supply is configured to apply the voltage to the secondary transfer inner roller.

8. The image forming apparatus according to claim 1, wherein the secondary transfer member comprises a secondary transfer outer roller configured to form a secondary transfer nip with an outer surface of the intermediate transfer belt, and the power supply is configured to apply the voltage to the secondary transfer outer roller.

9. An image forming apparatus comprising:

an image bearing member configured to bear an electrostatic image;

a developing unit configured to accommodate developer containing toner and carrier, and develop the electrostatic image formed on the image bearing member with toner into a toner image;

a toner supply unit configured to supply toner to the developing unit;

a toner density detection sensor configured to detect information related to a toner density in the developing unit;

an intermediate transfer belt to which the toner image is primarily transferred from the image bearing member;

a secondary transfer member configured to perform secondary transfer of the toner image on the intermediate transfer belt to a recording material;

a power supply configured to apply voltage to the secondary transfer member;

a control unit configured to control a supply quantity of toner from the toner supply unit to the developing unit based on the toner density detected by the toner density detection sensor and a target toner density, and control the power supply so that a voltage applied to the secondary transfer member from the power supply is set to a target transfer bias; and an image density detection sensor configured to detect an image density of a toner image for control transferred from the image bearing member to the intermediate transfer belt, wherein, during a continuous image forming job, the control unit is configured to execute a mode of detecting the image density of the toner image for control in which the toner image for control is transferred to an area of the intermediate transfer belt between a postion corresponding to a first recording material and a position corresponding to a second recording material succeeding the first recording material and the image density of the toner image for control is detected by the image density detection sensor, and in a case where the image density detected in the mode is higher by a predetermined threshold or more than a reference density, the control unit is configured to set the target toner density so that the target toner density becomes lower than that before execution of the mode and also sets the target transfer bias so that the target transfer bias set for transfer to the second recording material becomes lower than the target transfer bias set for transfer to the first recording material.

10. The image forming apparatus according to claim 9, wherein the predetermined threshold is a first predetermined threshold, and in a case where the image density detected in the mode is higher than the reference density by a second predetermined threshold which is lower than the first predetermined threshold or more, and not higher than the reference density by the first predetermined threshold, the control unit is configured to set the target toner density so that the target toner density is lower than that before the execution of the mode and also set the target transfer bias so that the target transfer bias set for transfer to the first recording material and the target transfer bias set for transfer to the second recording material are the same.

11. The image forming apparatus according to claim 9, wherein the control unit is configured to set the target toner density within a range between an upper limit value and a lower limit value set in advance based on the image density detected in the mode and the reference density, and in a case where the image density detected in the mode is higher than the reference density by the predetermined threshold or more, if the target toner density has not reached the lower limit value, a ratio of reducing the target transfer bias set for transfer of the second recording material with respect to the target transfer bias set for transfer of the first recording material is a first value, and if the target toner density has reached the lower limit value, a ratio of reducing the target transfer bias set for transfer of the second recording material with respect to the target transfer bias set for transfer of the first recording material is a second value that is greater than the first value.

* * * * *